United States Patent [19]

Grunz

[11] 4,451,940

[45] Jun. 5, 1984

[54] TOILET SEAT AND COVER ASSEMBLY

[76] Inventor: James H. Grunz, 5080 Woodson Dr., Mission, Kans. 66202

[21] Appl. No.: 431,787

[22] Filed: Sep. 30, 1982

[51] Int. Cl.[3] ..... A47K 13/00

[52] U.S. Cl. ..... 4/234; 4/237

[58] Field of Search ..... 4/237, 240, 234, 239, 4/661, 236

[56] References Cited

U.S. PATENT DOCUMENTS

| | | | |
|---|---|---|---|
| 2,517,755 | 8/1950 | Yumoto | 4/234 |
| 3,517,396 | 6/1970 | Wert | 4/234 |
| 3,520,005 | 7/1970 | Downes | 4/234 |
| 3,639,922 | 2/1972 | Samuels et al. | 4/237 |
| 4,155,127 | 5/1979 | Seiderman | 4/234 |

*Primary Examiner*—Henry K. Artis

[57] ABSTRACT

This invention related to solid and/or cushioned toilet seat assemblies. More specifically this invention is directed to a toilet seat assembly wherein the seat and cover have magnetic elements to prevent the seat from falling down while in use of while the toilet bowl is being cleaned.

8 Claims, 4 Drawing Figures

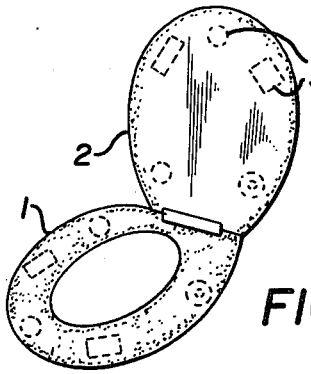
FIG. 1
FIG. 4
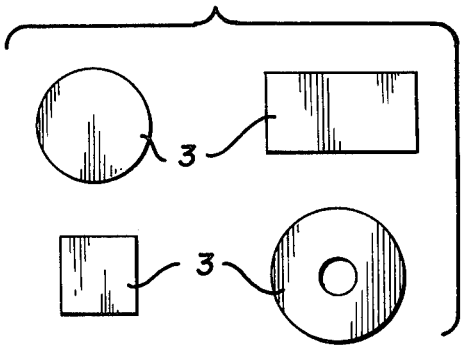
FIG. 2
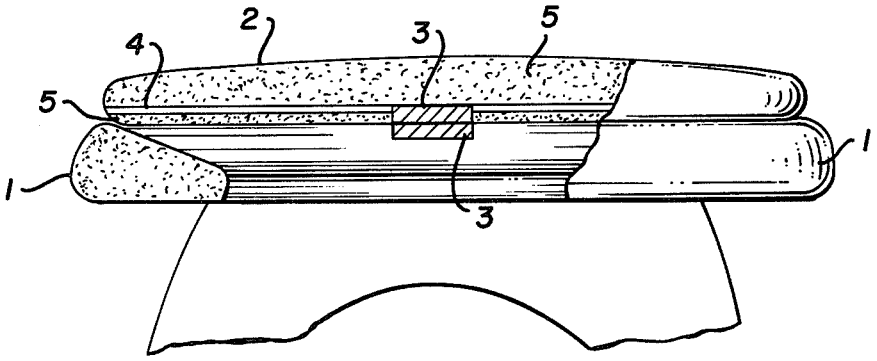
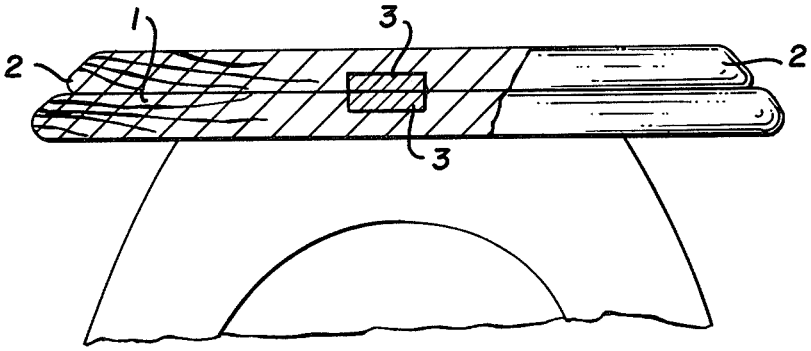
FIG. 3

TOILET SEAT AND COVER ASSEMBLY

This invention is directed to toilet seat assemblies comprising a bowl seat and seat cover, and is directed particularly to magnet elements affixed or embedded in the cover and/or seat.

A common problem with toilet seat and cover asemblies is the possibility of the assembly accidentally falling down from the preferred upward position while the toilet is in use by a male urinating or the toilet is being cleaned by someone. This problem can occur more frequently if the toilet tank and toilet seat cover are covered with decorative fabric.

Furthermore, recent development of cushioned assemblies has made them more susceptible to this problem because they are much thicker than most wood or plastic composition assemblies. This is especially true of the seat portion of the assembly.

It is accordingly, the principal object of this invention to obviate such accidents by incorporating one or more magnetic elements. In studying other ways to obviate such accidents; hooks, latches, fabric hook and loop fasteners were dismissed as being possibly unhygenic becauase they could harbor bacteria, viruses, urine, fecal matter, etc. This invention incorporates the magnetic elements beneath a thin layer of seat and cover material in such a manner as toeliminate all potential harbors.

Likewise spring mechanisms and foot pedal linkage were dismissed as being either too complicated or having the potentail for hygiene problems.

Other objects, features and advantages of this invention will be apparent from the following description when read with reference to the accompanying drawings. In the drawings, wherein like reference numeral denote corresponding parts throughout the several views:

FIG. 1 is a perspective view of a seat and cover assembly embodying the invention.

FIG. 2 is a partial section of a typical cushioned seat and cover in the upward position.

FIG. 3 illustrates a partial section of a typical plastic or wood composition seat in the upward position.

FIG. 4 illustrates some of the possible shapes for the magnetic elements with the cylindrical shape being used coincidentally in the other figures.

DESCRIPTION OF THE INVENTION

In FIG. 1 the seat 1 and cover 2 assembly is shown with the possible magnetic element 3 location or locations show as hidden lines. Multiple magnetic elements 3 may be necessary on assemblies having greater mass, such as solid wood assemblies.

In FIG. 2 the cushioned seat of the type disclosed in U.S. Pat. Nos. 3,517,396 and 3,988,789 is shown with the seat 1 and cover 2 assembly in the upward position. Insertion of the magnetic element(s) 3 is achieved by creating a suitable cavity in the semi-rigid cover base 4. If the cover 2 is to have cover padding 5 on the side facing the seat 1 the areas of padding between the magnetic elements 3 and the impervious cover skin 6 should be removed to ensure the maximum attraction between magnetic elements 3. Furthermore, in the case of a heavily padded cover base 4 the magnetic elements 3 may be joined to the surface of the cover base 4 by fasteners or adhesives, thereby obviating the need and expense of creating a cavity in the cover base 4. Insertion of the magnetic element(s) 3 into the seat 1 is achieved by creating a suitable cavity in the seat padding 7 on the side facing the cover 2.

The preferred location of the magnetic elements 3 in the seat 1 and cover 2 is that which gives the maximum attractive force, through the cover skin 6 and seat skin 8.

For solid seats of wood, wood composition or plastic composition as shown in FIG. 3, the magnetic elements 3 are inserted into suitable cavities created by physical methods such as drilling or created by proper forming mold design.

Some of the possible shapes for the magnetic elements 3 are shown in FIG. 4. Selection to shape, magnetic strength is generally governed by analysis of cost-effectiveness.

The foregoing descriptions of the materials and their configuration are illustrative of ones suitable for this invention and as such may include other materials or configurations to provide for increased magnetic attractive forces, hygienic qualities and visual attractiveness. Coloring and other decorative materials may be incorporated also to enable amost unlimited effects.

While certain representative embodiments and details have been shown for the purpose of illustrating the invention, it will be apparent to those skilled in the art that various changes and modifications may be made therein without departing from the spirit or scope of the invention:

I claim:

1. A toilet seat structure having a water tank, a bowl, a seat normally resting horizontally on the bowl, a cover normally horizontally resting on the seat and hinge means secured to the bowl in interconnecting relationship to the seat and the cover for swinging movement thereof separately or together toward an upstanding position adjacent the tank, releasable means for preventing the seat from swinging toward the bowl by gravitation when the seat and the cover are in said upstand position, said releasable means comprising:

at least one element for the seat and for the cover respectively, said elements being characterized by having a magnetic force acting mutually therebetween tending to draw the same together and resisting their separation when the elements are in relatively close proximity to each other; and means attaching the elements to the seat and to the cover in position for bringing the elements into said relatively close proximity to each other when the seat and cover are swung to said upstanding position.

2. The invention of claim 1, one element being adjacent the normally uppermost surface of the seat, the other element being adjacent the normally lowermost surface of the cover.

3. The invention of claim 1, the elements being at least partially embedded in the seat and the cover respectively.

4. The invention of claim 1, the elements being in face-to-face interengagement when both the seat and the cover are horizontally disposed and when the same are both in said upstanding position.

5. The invention of claim 1, the elements being disposed in diametrically opposed relationship to said hinge means.

6. The invention of claim 1, and means on the seat and on the cover respectively obscuring the elements from view and for hygenic purposes.

7. The invention of claim 1, the seat and cover being padded and having their elements extending into their paddings.

8. The invention of claim 1, the cover having a base and having its element extending into its base.

* * * * *

UNITED STATES PATENT AND TRADEMARK OFFICE

CERTIFICATE OF CORRECTION

PATENT NO. : 4,451,940

DATED : June 5, 1984

INVENTOR(S) : James H. Gruns

It is certified that error appears in the above-identified patent and that said Letters Patent is hereby corrected as shown below:

On the title page, inventor's name should read

-- James H. Gruns --.

Signed and Sealed this

*Twenty-sixth* Day of *February 1985*

[SEAL]

*Attest:*

DONALD J. QUIGG

*Attesting Officer* *Acting Commissioner of Patents and Trademarks*